US006325253B1

(12) United States Patent
Robinson

(10) Patent No.: US 6,325,253 B1
(45) Date of Patent: Dec. 4, 2001

(54) SELF-CLOSING FLUID DISPENSING CLOSURE

(75) Inventor: Philip J. Robinson, Sylvania, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/776,357

(22) Filed: Feb. 2, 2001

(51) Int. Cl.[7] ..... B65D 37/00
(52) U.S. Cl. ..... 222/212; 222/494
(58) Field of Search ..... 222/494, 420, 222/212, 215

(56) References Cited

U.S. PATENT DOCUMENTS

| | | | |
|---|---|---|---|
| 1,621,097 | | 3/1927 | Zammataro . |
| 1,878,833 | | 9/1932 | Ellyson . |
| 1,908,584 | | 5/1933 | Weirich . |
| 1,987,156 | | 1/1935 | Paparello . |
| 2,715,980 | | 5/1955 | Frick . |
| 3,412,910 | | 11/1968 | Hahn . |
| 3,981,419 | | 9/1976 | Nilson . |
| 4,141,474 | | 2/1979 | Nilson . |
| 4,141,475 | | 2/1979 | Nilson . |
| 4,739,906 | | 4/1988 | LoTurco . |
| 4,846,810 | | 7/1989 | Gerber . |
| 5,012,956 | | 5/1991 | Stoody . |
| 5,033,655 | * | 7/1991 | Brown ..... 222/212 |
| 5,080,138 | | 1/1992 | Haviv . |
| 5,092,855 | | 3/1992 | Pardes . |
| 5,154,325 | * | 10/1992 | Ryder et al. ..... 222/215 |
| 5,836,484 | | 11/1988 | Gerber . |
| 6,079,449 | | 6/2000 | Gerber . |
| 6,083,450 | | 7/2000 | Safian . |
| 6,199,725 | * | 3/2001 | Garibaldi ..... 222/494 |

FOREIGN PATENT DOCUMENTS

| | | |
|---|---|---|
| 2106480 | 4/1983 | (GB) . |

* cited by examiner

*Primary Examiner*—Philippe Derakshani

(57) ABSTRACT

A fluid dispensing closure includes a housing having a base with an internal thread or bead for securement to a container, and a peripheral wall extending from the base and converging toward an opening spaced from the base. A flexible resilient liner is captured within the peripheral wall of the housing. The liner has a flange extending axially through the opening at the upper end of the housing and radially overlying the peripheral wall of the housing. A flow tip, which has a body with at least one flow passage, is captured within the liner, and extends through the liner flange and the housing opening. Pressure applied to the flange by fluid in the passage resiliently expands the flange away from the flow tip to permit egress of fluid from the passage, and removal of such fluid pressure allows resilient collapse of the liner over the passage.

19 Claims, 3 Drawing Sheets

SELF-CLOSING FLUID DISPENSING CLOSURE

The present invention is directed to closures for dispensing fluids from container packages, and more particularly to a closure and method of manufacture that open to dispense fluid under pressure from within a container and that are self-closing when fluid pressure is removed to prevent return of fluid or other contaminants into the container.

BACKGROUND AND SUMMARY OF THE INVENTION

It is a general object of the present invention to provide a fluid dispensing closure that, when used in combination with a container that provides little or no internal vacuum as fluid is dispensed, prevents flow of return fluid or gas into the container after the fluid is dispensed, and thereby prevents ingress of debris or organisms and maintains pristine conditions within the container. Other objects of the invention are to provide a method of making such a closure, and a package that contains such a closure.

A fluid dispensing closure in accordance with a presently preferred embodiment of the invention includes a flow tip having an exterior peripheral surface and at least one fluid passage extending from an inner end of the flow tip to a position spaced from an outer end of the flow tip. A flexible resilient liner embraces the exterior surface of the flow tip, and has an outer end that overlies and closes the upper end of the flow passage. A housing exteriorly secures the liner to the flow tip, with the outer end of the liner and the outer end of the flow tip extending through an opening at the end of the housing. Pressure applied by fluid in the flow passage resiliently expands the outer end of the liner away from the outer surface of the flow tip to permit egress of fluid from the passage, and removal of pressure from the fluid in the passage allows collapse of the outer end of the liner over the outer end of the passage to prevent return of fluid or other debris into the passage and into a container to which the closure is secured. (Directional adjectives such as "inner" and "outer" are taken with respect to the interior of the container illustrated in the drawings.)

A fluid dispensing closure in accordance with the preferred embodiment of the invention includes a housing having a base with an internal thread or bead for securement to a container, and a peripheral wall extending from the base and converging toward an opening spaced from the base. A flexible resilient liner is captured within the peripheral wall of the housing. The liner has a flange extending axially through the opening at the end of the housing and radially overlying the peripheral wall of the housing. A flow tip, which has a body with at least one flow passage, is captured within the liner, and extends through the liner flange and the housing opening. Pressure applied to the flange by fluid in the passage resiliently expands the flange away from the flow tip to permit egress of fluid from the passage, and removal of such fluid pressure allows resilient collapse of the liner over the passage. In the preferred embodiment of the invention, the liner flange has a radially outwardly facing surface that blends with a radially outwardly facing surface of the housing peripheral wall to permit free flow of excess fluid along the outer surfaces of the flange and wall away from the flow tip. The exterior peripheral surface of the flow tip, the liner flange and the housing peripheral wall are outwardly convex and converge toward the upper end of the closure, which further enhances flow of excess fluid away from the flow tip. The resilient liner or the flow tip may be impregnated with an antibacterial agent to help prevent growth of bacteria on the exterior surface of the flow tip and the flange between uses of the closure and package.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
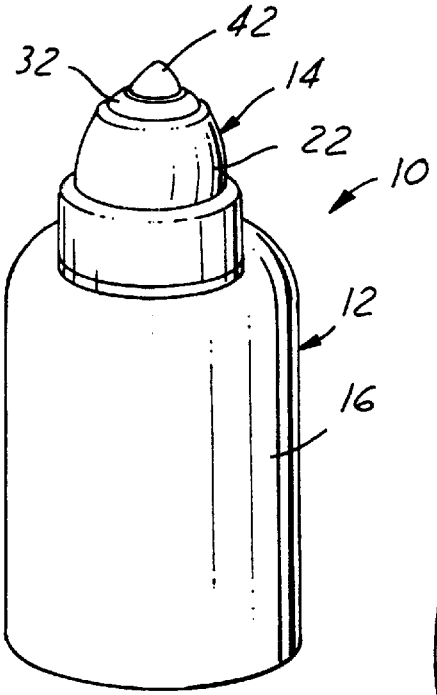
FIG. 1 is a perspective view of a closure and container package in accordance with a presently preferred embodiment of the invention.
Figure 3:
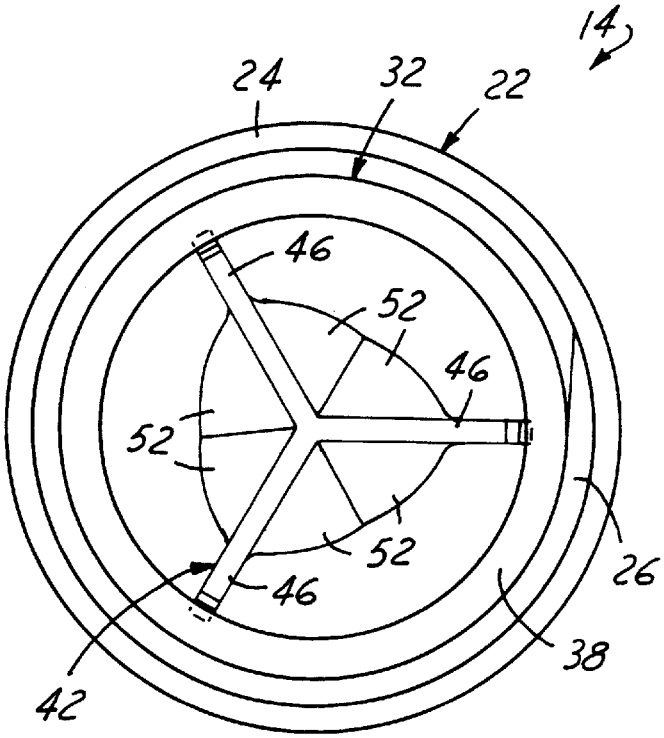
FIG. 3 is a bottom plan view of the fluid dispensing closure illustrated in FIGS. 1 and 2.
Figure 4:
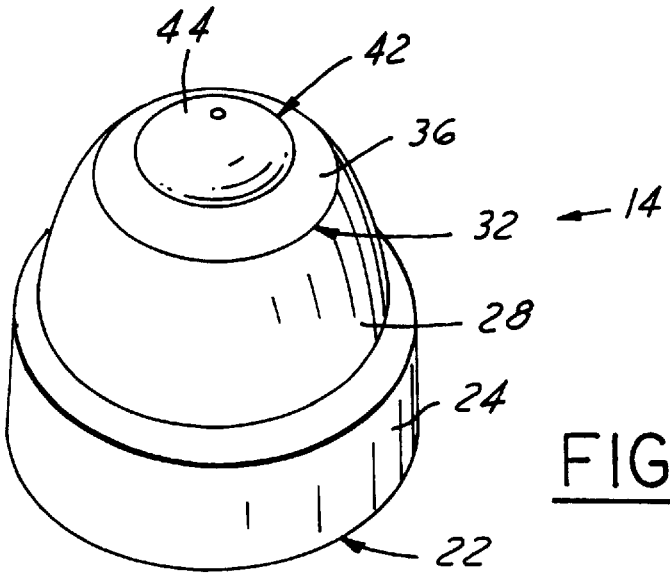
FIG. 4 is a perspective view of the closure illustrated in FIGS. 1–3.
Figure 2:
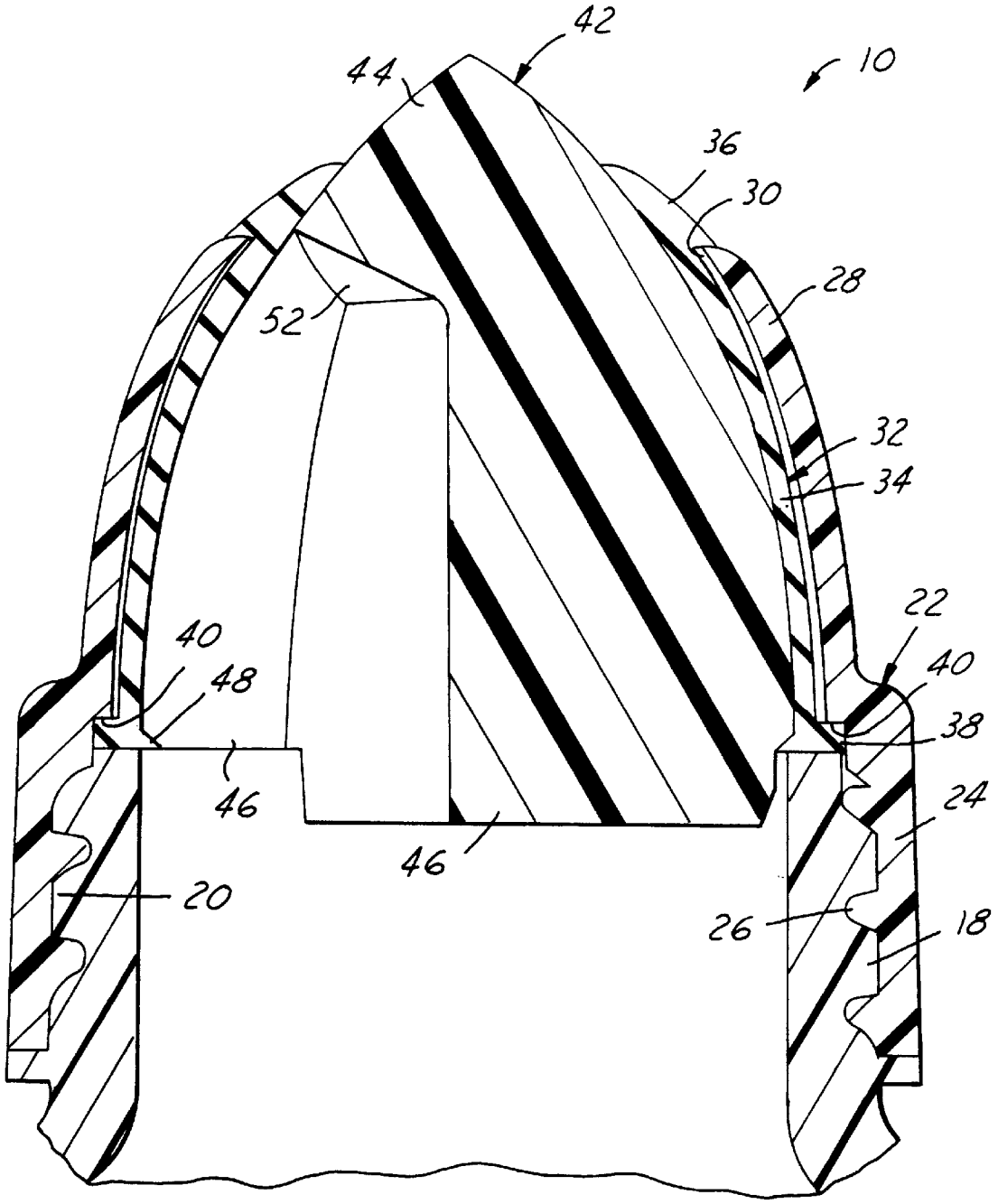
FIG. 2 is a fragmentary sectional view of the closure secured to the container finish in the embodiment of FIG. 1.
Figure 5:
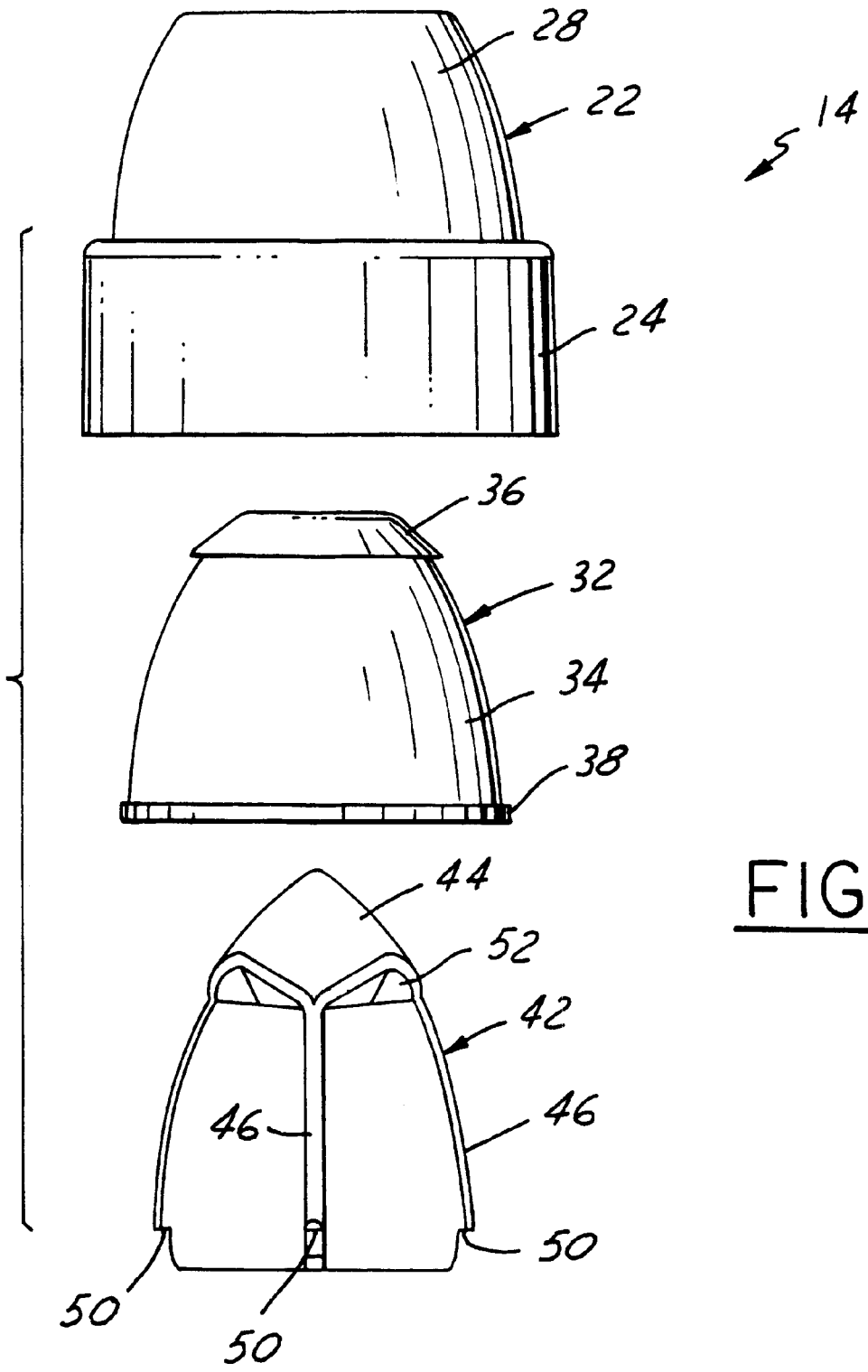
FIG. 5 is an exploded elevational view of the closure illustrated in FIGS. 1–4.

FIGS. 1 and 2 illustrate a fluid dispensing package 10 as comprising a container 12 having a fluid dispensing closure 14 secured thereto. Container 12 comprises a container body 16 having an integral axially extending finish 18. Finish 18 has an external thread or bead 20 to which closure 14 is secured. Container 12 may be of any suitable construction, such as flexible resilient blow-molded plastic construction. Container 12 may be of a type illustrated in U.S. Pat. No. 6,083,450, having an internal liner for containing the fluid to be dispensed and an atmospheric vent with a check valve to prevent creation of sub-atmospheric pressure (vacuum) between the liner and the container body. Other conventional containers may also be employed as long as flow is initiated by actuation of pressure applied to the fluid within the container, such as by squeezing or pumping action, and little or no internal vacuum is created within the container as fluid is dispensed.

Closure 14 includes a housing 22 having a cylindrical base or skirt 24 with an internal thread or bead 26 for securement over external thread or bead 20 on container finish 18. A peripheral wall 28 coaxially extends from the housing skirt and converges toward a circular opening 30 at its upper or outer end spaced from the housing skirt. Circular opening 30 is coaxial with the housing axis and lies in a plane perpendicular to such axis. A circumferentially symmetrical flexible resilient liner 32 has a body 34 captured within peripheral wall 28 of housing 22. Liner 32 has a flange 36 extending axially through opening 30 at the outer end of housing peripheral wall 28, and radially overlying the axial outer edge of peripheral wall 28 around opening 30. A lower flange 38 extends radially outwardly from the lower end of liner body 34, and is captured beneath a shoulder 40 at the lower or inner end of housing peripheral wall 28 adjacent to skirt 24. Liner 32 is thus resiliently captured in assembly to housing 22 between flange 36 and flange 38.

A flow tip 42 is captured within liner 32 and housing 22. Flow tip 42 is preferably a one-piece body having a solid upper or outer end 44 and a plurality of circumferentially spaced radial vanes 46 integrally axially extending from outer end 44. The spaces between vanes 46 terminate at radially outwardly and axially upwardly angulated surfaces 52 that define the underside of end 44, which in turn terminate at the outer surface of flow tip 42 beneath liner flange 36 and above the outer edge of housing wall 28. Vanes 46 and surfaces 52 thus form fluid flow passages that extend from the inner end of closure 10 to a position radially inward of flange 36 on liner 22. Three vanes 46 at 120° spacing are illustrated in the embodiment of FIGS. 1–5, thus defining three angularly spaced axially extending fluid flow passages between the vanes. A radially inwardly extending flange 48 at the inner end of liner 32 is received in notches 50 (FIG. 5) at the inner ends of vanes 46 to capture flow tip 42 in assembly. Housing peripheral wall 28, liner 32 and flow tip 42 are all outwardly convex in the preferred embodiment. Liner 32 nests snuggly in assembly within peripheral wall 28, and flow tip nests snuggly in assembly within liner 32. Housing 22 and flow tip 42 may be of any suitable molded plastic construction, such as polypropylene or polyethylene such as HDPE. Liner 32 may be of any suitable flexible resilient construction such as a thermoplastic elastomer (TPE), rubber or silicone. A TPE marketed by Advanced Elastomer Systems under the trademark SANTOPRENE is currently preferred. Flow tip 42 and/or liner 32 maybe impregnated with an antibacterial agent to prevent formation of mold and the like. When closure 14 is applied to container finish 18, compression of liner flanges 38, 48 pushes flow tip 42 upwardly against the upper portion of liner 32. This helps seal the liner within housing 22, particularly when the liner may have been relaxed by irradiation for sterilization purposes. Liner flange 38 also functions as a seal against container finish 18.

To dispense fluid, the sidewall of container body 16 is squeezed or the bottom wall of container body 16 is depressed so that fluid is urged under pressure through the passages between vanes 46 and applies an outward pressure to flange 36 of liner 32. (Package 10 would typically be inverted to dispense fluid, such as eye drops.) Flange 36 is radially outwardly expanded by such fluid pressure over the outer edge of housing wall 28, so that fluid may flow through the valve created by flange 36 for dispensing as desired. When fluid pressure is released, flange 36 collapses radially inwardly against the outer surface of flow tip upper end 44 so as to close the fluid passages and prevent any fluid that may remain on flow tip 42 from returning to the container when the package is returned to the upright orientation illustrated in the drawings. It will be noted that peripheral wall 28 of housing 22 is outwardly convex and converges toward opening 30. The outer surface of flange 36 is likewise outwardly convex and contoured to blend with the outer surface of the flow tip so as to blend with the outer surface of peripheral wall 28 and thereby promote flow of any excess fluid from the flow tip downwardly along the exterior surface of flange 36 and peripheral wall 28. Likewise, the upper end 48 of flow tip 42 is outwardly convex and converges to a point to promote such flow of excess fluid away from the upper end of the flow tip. The outwardly convex conical surface and pointed end of flow tip end 44 are designed to produce droplets when container package 10 is inverted and squeezed. The fluid rolls along the outer surface of the flow tip, gathers at the tip and drops off. The size of the drop is controlled in part by the radius at the tip, with a smaller radius producing smaller drops. Flow tip 42, flange 36 and housing wall 28 may be of other suitable less preferred contour, such as conical.

The closure of the present invention thus exhibits a number of advantages. The closure allows fluid to be dispensed while inhibiting ingress of gas, fluid or accompanying microorganisms to replace the fluid as it is dispensed. The closure snaps together and can be readily assembled as a single unit, which in turn can be readily secured to a container finish after the container is filled by a packager. Liner 32 is securely installed into housing 22 between flanges 36 and 38, and flow tip 42 is secured within liner 22 by means of liner bead 48 and notches 50 on the flow tip. The closure is compatible with standard or custom types of container finishes, and may be readily fabricated in a number of sizes. The particular flow tip 42 illustrated in the drawings is designed to dispense liquid in droplets, but can be readily modified to dispense liquid in a stream or other form. The housing, liner and flow tip are designed to direct any residual fluid away from the dispensing area and down the outside of the closure to minimize any chance of contamination of successive fluid dosages at the dispensing area. As best seen in FIG. 2, flange 38 of liner 32 is engaged by the upper end of container finish 18, and thus acts as a sealing liner between the closure and the container finish. Flow tip vanes 46 automatically locate liner 32 relative to housing 22 during assembly, and maintain a consistent seal between the outside surface of the liner and the inside surface of the housing. Flexibility of liner 32 at the container finish allows differing types of closure attachment to the container, such as threaded attachment as illustrated and bead-type snap fit attachment as described. The closure may also be equipped with means such as ratchets to make it non-removable from the container. The closure may optionally be enclosed by a threaded, snap-fit or hinged overcap.

There have thus been disclosed a closure, a closure and container package, and a method of closure manufacture that fully satisfy all of the objects and aims previously set forth. A number of modifications and variations have been described. Other modifications and variations will readily suggest themselves to persons of ordinary skill in the art. The invention is intended to embrace all such modifications and variations as fall within the spirit and broad scope of the appended claims.

What is claimed is:

1. A fluid dispensing closure that comprises:

a flow tip having an exterior peripheral surface and at least one fluid passage extending along said exterior peripheral surface from an inner end of said flow tip to a position spaced from an outer end of said flow tip, a liner of flexible resilient construction embracing said exterior surface of said flow tip forming an outer wall of said at least one passage, and having an outer end that overlies and closes said outer end of said at least one flow passage, and a housing exteriorly securing said liner to said flow tip, said outer end of said liner and said outer end of said flow tip extending through an outer end of said housing, such that pressure applied by fluid in said at least one passage resiliently expands said outer end of said liner away from said outer surface of said flow tip to permit egress of fluid from said at least one passage, and removal of pressure applied by fluid in said at least one passage allows collapse of said outer end of said liner over said outer end of said passage to prevent return of fluid to said passage.

2. The closure set forth in claim 1 wherein said liner outer end includes a flange that extends axially along said flow tip, resiliently engaging said exterior surface of said flow tip, and radially outwardly over said outer end of said housing.

3. The closure set forth in claim 2 wherein said liner flange has a radially outwardly facing surface that blends with a radially outwardly facing surface of said housing to permit flow of excess fluid along said radially outwardly facing surfaces away from said flow tip.

4. The closure set forth in claim 3 wherein said liner has a second radially outwardly facing flange at an inner end thereof opposed to said outer end, said liner being captured within said housing by said flanges.

5. The closure set forth in claim 3 wherein said outer end of said flow tip is solid, and wherein said at least one passage is formed between vanes that are circumferentially spaced from each other around said flow tip.

6. The closure set forth in claim 5 wherein there are three said vanes at 120° spacing from each other.

7. The closure set forth in claim 1 wherein said housing has a base with a peripheral skirt and internal means for securing the closure to a container.

8. The closure set forth in claim 1 wherein said exterior peripheral surface of said flow tip, said liner and said housing are outwardly convex and converge toward said upper end of said flow tip.

9. The closure set forth in claim 1 wherein said flow tip and/or said liner is impregnated with an antibacterial agent.

10. A fluid dispensing closure that comprises:

a housing having a base with means for securement to a container, and a peripheral wall extending from said base and converging toward an opening spaced from said base, a flexible resilient liner captured within said peripheral wall of said housing, said liner having a flange extending axially through said opening and radially overlying said peripheral wall, and a flow tip having a body, with at least one peripheral flow passage, captured within said liner, and a tip extending through said flange and said housing opening, such that pressure applied to said flange by fluid in said at least one passage resiliently expands said flange away from said flow tip to permit egress of fluid from said at least one passage, and removal of such fluid pressure allows resilient collapse of said liner flange over said passage.

11. The closure set forth in claim 10 wherein said liner flange has a radially outwardly facing surface that blends with a radially outwardly facing surface of said housing peripheral wall to permit flow of excess fluid along said radially outwardly facing surfaces away from said flow tip.

12. The closure set forth in claim 10 wherein exterior peripheral surfaces of said flow tip, said liner and said housing are outwardly convex and converge toward an upper end of said closure.

13. The closure set forth in claim 10 wherein said flow tip and/or said liner is impregnated with an antibacterial agent.

14. A closure and container package that includes:

a container having a finish with external means for securing a closure and a fluid dispensing closure that includes:

a housing having a base with means secured to said external means on said container, and a peripheral wall extending from said base and converging toward an opening spaced from said base, a flexible resilient liner captured within said peripheral wall of said housing, said liner having a flange extending axially through said opening and radially overlying said peripheral wall, and a flow tip having a body, with at least one peripheral flow passage, captured within said liner, and a tip extending through said flange and said housing opening, such that pressure applied to said flange by fluid in said at least one passage resiliently expands said flange away from said flow tip to permit egress of fluid from said at least one passage, and removal of such fluid pressure allows resilient collapse of said liner flange over said passage.

15. The package set forth in claim 14 wherein said liner flange has a radially outwardly facing surface that blends with a radially outwardly facing surface of said housing peripheral wall to permit flow of excess fluid along said radially outwardly facing surfaces away from said flow tip.

16. The package set forth in claim 14 wherein exterior peripheral surfaces of said flow tip, said liner and said housing are outwardly convex and converge toward said upper end of said closure.

17. The package set forth in claim 13 wherein said flow tip and/or said liner is impregnated with an antibacterial agent.

18. A method of making a fluid dispensing closure that comprises the steps of:

(a) providing a housing having a base with means for securement to a container, and a peripheral wall extending from said base and converging toward an opening spaced from said base, (b) securing within said housing peripheral wall a flexible resilient liner having a flange extending axially through said opening and radially overlying said peripheral wall, and (c) securing within said liner a flow tip having a body with at least one flow passage and a tip that extends through said flange and said housing opening.

19. The method set forth in claim 18 comprising the additional step of impregnating said flow tip and/or said liner with an antibacterial agent.

* * * * *